United States Patent [19]

Frolov

[11] Patent Number: 4,981,312

[45] Date of Patent: Jan. 1, 1991

[54] ELECTROMAGNETIC SHEAR LOCK

[75] Inventor: George Frolov, Farmington, Conn.

[73] Assignee: Harrow Products, Inc., Grand Rapids, Mich.

[21] Appl. No.: 213,084

[22] Filed: Jun. 29, 1988

[51] Int. Cl.[5] ..... E05C 19/16

[52] U.S. Cl. ..... 292/251.5; 248/27.1; 248/558; 248/602; 335/279; 403/4

[58] Field of Search ..... 335/274, 279; 248/27.1, 248/544, 916, 588, 558, 602; 403/4; 292/251.5, DIG. 60, DIG. 55, 341.18, 341.19

[56] References Cited

U.S. PATENT DOCUMENTS

| | | | |
|---|---|---|---|
| 2,584,707 | 2/1952 | Jarvis et al. | 335/279 |
| 2,673,626 | 3/1954 | Bastin | 292/251.5 |
| 2,801,870 | 8/1957 | Davey | 292/251.5 |
| 2,812,965 | 11/1957 | Horvay | 292/251.5 |
| 2,906,553 | 9/1959 | Wilson | 292/251.5 |
| 3,204,154 | 8/1965 | Crandell . | |
| 3,993,972 | 11/1976 | Barbrook | 335/220 |
| 4,439,808 | 3/1984 | Gillham | 361/144 |
| 4,487,439 | 12/1984 | McFadden | 292/251.5 |
| 4,491,816 | 1/1985 | Blum | 335/245 |
| 4,562,665 | 1/1986 | Blackston | 49/44 |
| 4,645,089 | 2/1987 | Horsley | 248/27.1 X |
| 4,652,028 | 3/1987 | Logan et al. | 292/251.5 |
| 4,682,801 | 7/1987 | Cook et al. | 292/251.5 |
| 4,688,012 | 8/1987 | Bohg et al. | 335/276 |
| 4,703,962 | 11/1987 | Kelly et al. | 292/251.5 |
| 4,716,393 | 12/1987 | Logie | 335/261 |
| 4,720,128 | 1/1988 | Logan, Jr. et al. | 292/251.5 |

FOREIGN PATENT DOCUMENTS

| | | | |
|---|---|---|---|
| 226753 | 2/1960 | Australia | 292/251.5 |
| 0049580 | 4/1982 | European Pat. Off. | 292/251.5 |
| 1194528 | 5/1959 | France | 292/251.5 |

*Primary Examiner*—Lloyd A. Gall

*Attorney, Agent, or Firm*—Robert H. Montgomery

[57] ABSTRACT

An electromagnetic shear lock comprising an electromagnet having an E-shaped cross section with a coil positioned about the middle leg of the E is mounted to a doorway and an armature is mounted to the door, where in one form the middle leg of the E is shortened to define a recess to receive an elongated armature member and provide mechanical reinforcement against shearing when the electromagnet is energized. The armature is constructed of at least two telescoping members where the outer armature member is U-shaped with legs which contact the outer legs of the electromagnet and the inner member is attracted into the defined recess and will engage the inner surfaces of the outer legs of the electromagnet. Even if the outer member is pryed down from the electromagnet, at least the inner armature members will still be in a magnetic circuit with the inner electromagnet armature member in the defined recess and providing mechanical reinforcement in engaging the inner surfaces of the outer legs. The invention further provides a new and improved structure for mounting the armature to a door.

9 Claims, 2 Drawing Sheets

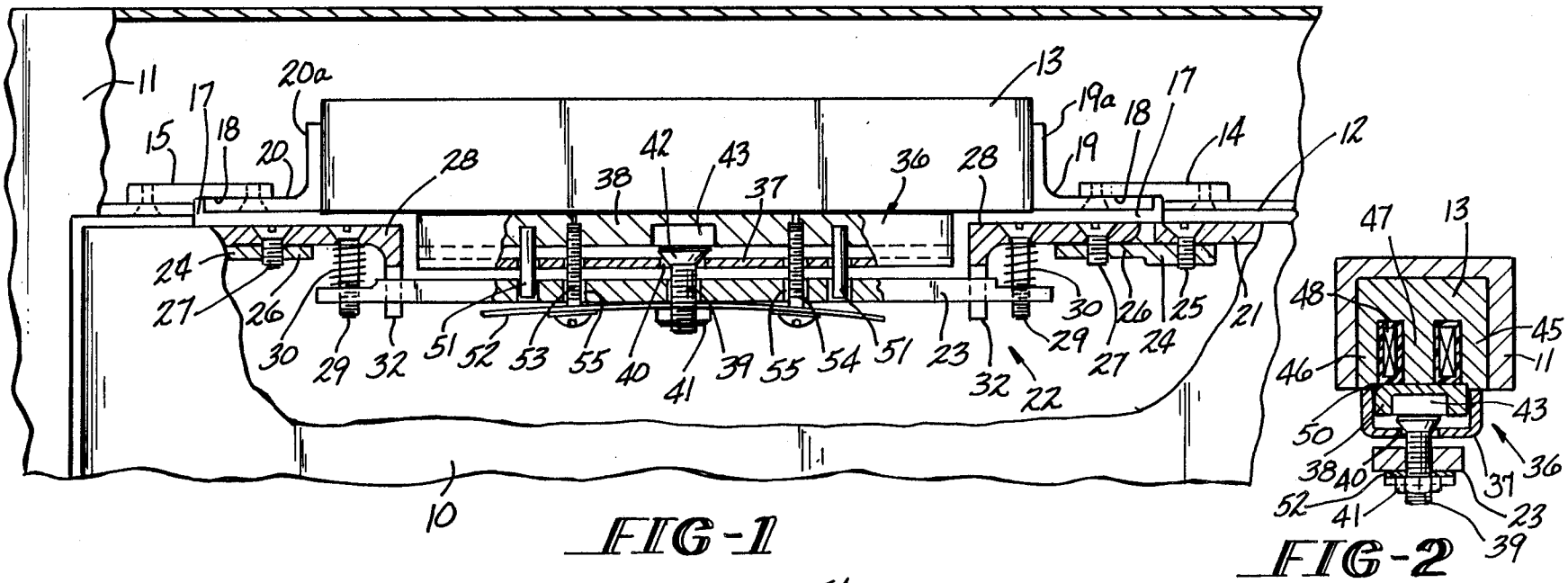
FIG-1
FIG-2
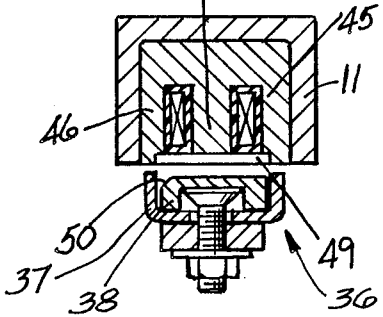
FIG-3
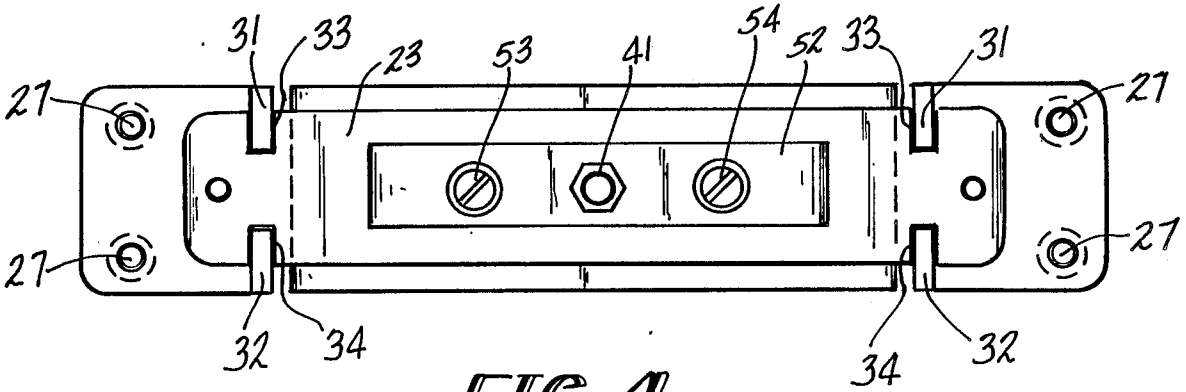
FIG-4

ELECTROMAGNETIC SHEAR LOCK

FIELD OF THE INVENTION

This invention relates to electromagnetic door locks, and more particularly, to electromagnetic door locks of the type known as shear locks.

BACKGROUND OF THE INVENTION

Electromagnetic security locks are well known in which an electromagnet is mounted to one of a door frame or a door and an armature is mounted to the other. In the predominant installations of such locks, the armature and electromagnet are generally mounted so that the face of the electromagnet and armature is parallel with a plane of the door and the holding force or attraction between the electromagnet and armature is perpendicular to the door when in a closed position. Any attempted forced opening of the door is resisted by the electromagnetic attraction of the armature to the electromagnet.

This type of arrangement is very effective, providing a locking force against unauthorized opening of a door. However, as is generally the case, the armature must be mounted on the vertical surface of the door, while the electromagnet is mounted from the door frame and overhangs the top edge of the door. This type of lock, while very effective from a security standpoint, is not suitable for mounting on many types of swinging or double-acting doors.

Also, in many instances, for aesthetic purposes, a better concealment of the electromagnetic lock is desirable. This has led to increased popularity of the so-called magnetic shear lock, in which the electromagnet is mounted within the door frame and an armature is mounted at or adjacent the top edge of the door and is adapted to be attracted to the electromagnet when the door is in a closed position.

This type of magnetic shear lock presents some technical problems which must be considered. When such a magnetic shear lock is mounted to a door and frame such that the electromagnet will exert an upward pull on the armature to achieve locking of the door, there must be some mechanical locking effort because the full magnetic attraction of the armature to the electromagnet is not available as a holding force when attempt is made to produce shearing movement between the armature and the electromagnet.

This problem has been recognized in U.S. Pat. No. 4,562,665, which discloses an armature mounted in the door which has two projections with vertical side walls which fit into two mating recesses in the electromagnet. Thus, when the armature is attracted to the electromagnet, the projections extend into the recesses and provide a mechanical lock. This type of construction does not take into account the possible effects of residual magnetism in the electromagnet when it may be deenergized to permit opening of the door, particularly if an opening force is applied to the door at the same time the electromagnet is deenergized. Specifically, if there is an attempt being made to open the door when the electromagnet is deenergized, the residual magnetism may still provide attraction between the armature and the electromagnet, and the vertical surfaces of the projections in the recesses will prevent opening of the door.

This problem appears to have been recognized in U.S. Pat. No. 4,487,439 in which a non-magnetic projection is placed in one of the armature and the electromagnet, and a recess for receiving the projection is defined in the other, and a beveled edge is defined on the projection to enable the armature to be pushed away from the electromagnet by a force attempting to open the door when the electromagnet is deenergized. In this construction, the projection has a matching circular indentation or recess somewhat larger in diameter than the projection. However, this type of construction suffers from a drawback in that when an attempt is made for unauthorized opening of the door, the circular pin or projection only makes a point contact with the recess in the armature, and this will very quickly show signs of wear after attempts to force the lock by applying shear force.

The problem of the residual magnetism in an electromagnetic shear lock which includes a mechanical reinforcing structure of the electromagnet when energized is discussed in U.S. Pat. No. 4,439,808. In the construction disclosed in this patent, a magnetic flux cancelling circuit is provided to overcome the residual magnetism in the electromagnet when the electromagnet is switched off.

Copending application Ser. No. 014,831 filed Feb. 13, 1987, assigned to the same assignee as the present invention, discloses a magnetic shear lock in which a small air gap is provided in the magnetic circuit between the electromagnet and the armature to prevent saturation and the resultant problems of residual magnetism.

Another problem has been discovered in the use of magnetic shear locks. This is the possibility of someone using a crowbar or other device to pry the armature away from the electromagnet and then open the previously locked door.

Further problems are presented in the installation of magnetic shear locks in mounting and leveling the armature in the door in operative relationship to the soffet mounted electromagnet. The construction of doors may vary and different mounting techniques may be required for different door structures.

Accordingly, the present invention provides a new and improved electromagnetic shear lock in which the effects of residual magnetism due to saturation of the magnetic members are overcome by a spring return of the armature and an armature construction which eliminates the possibility of prying the armature away from the electromagnet.

The present invention further provides new and improved techniques of mounting the armature to a door so that registry of the armature with the electromagnet is assured.

SUMMARY OF THE INVENTION

Briefly stated, the invention, in one form thereof, comprises an electromagnet having an E-shaped cross section adapted to be mounted to the frame or soffet of a door and an armature which is mounted at the top or bottom edge of the door. The armature is constructed and arranged for vertical movement for attraction to the electromagnet and to drop away therefrom under the force of gravity or spring loading when the electromagnet is not energized.

The middle leg of the E-shaped electromagnet is recessed beyond the outer legs and the armature is formed of two or more members which are telescoping. Upon attraction of the armature to the electromagnet, one portion or member of the armature is attracted between the outer legs while another portion of the armature is attracted to the inner leg. With this arrangement it is extremely difficult, if not impossible, to pry the portion of the armature which extends into the recess away from the electromagnet, in view of the construction that is hereinafter explained in detail. The second or outer armature member may possibly be pried away from the first armature member and the electromagnet. However, the first and second armature members are still in the same magnetic circuit, and the first armature member is held into engagement with the recessed middle leg of the electromagnet, and the top thereof cannot be reached with a pry bar, screwdriver or other tool to attempt to pry the armature from the electromagnet.

The invention further considers the fact that not all door tops or bottoms are parallel with the corresponding jamb or sill, and provides a new and improved adjustment mechanism for the armature so as to insure flush engagement with the electromagnet.

An object of this invention is to provide a new and improved magnetic shear lock that is resistant to any attempt to pry the armature from the electromagnet.

A further object of this invention is to provide a new and improved mounting for the armature of a magnetic shear lock.

The features of this invention which are believed to be novel are particularly pointed out and distinctly claimed in the concluding portion of this specification. The invention, however, together with further objects and advantages thereof, may best be appreciated by reference to the following detailed description taken in conjunction with the drawings.

BRIEF DESCRIPTION OF THE DRAWINGS

FIG. 1 is a front elevation of a portion of a door and door frame partially cut away to show the installation of a magnetic shear lock embodying the invention;

FIG. 2 is a cross-sectional view of FIG. 1 when the electromagnet is energized;

FIG. 3 is a view similar to FIG. 2 seen in the plane of lines 2—2 of FIG. 1 when the electromagnet is not energized;

FIG. 4 is a view of the armature assembly of FIG. 1 seen from the bottom thereof;

DESCRIPTION OF THE PREFERRED EMBODIMENTS OF THE INVENTION

Figure 5:
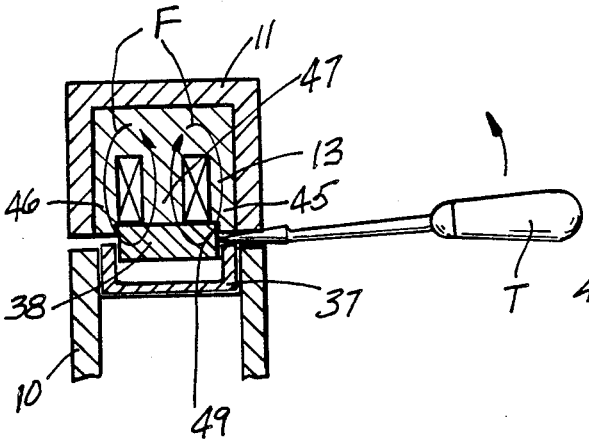
FIG. 5 is a view in half section of an electromagnet embodying the invention showing the resistance to an attempt to pry the from the electromagnet.

FIG. 1 exemplifies a door 10 closing a doorway. A door frame 11 is shown as being of a hollow metal configuration and a portion of the soffet 12 is removed therefrom to permit insertion of an electromagnet 13. When a portion of the door frame has been removed to define an opening into the hollow interior, mounting plates 14 and 15 are affixed to the soffet of the doorway by means of screws or bolts. The mounting plates 14 and 15 extend over the defined opening 17 in the door frame and are recessed on the bottom at 18. Non-magnetic L-shaped members 19 and 20 are secured to the recessed portion 18 mounting of plates 14 and 15, respectively, and provide upright arms 19*a* and 20*a* which receive electromagnet 13 therebetween. The electromagnet is secured to the upright arms 19*a* and 20*a* by a plurality of screws (not shown).

Electromagnet 13 is generally of E-shaped cross section as hereinafter described. The door 10 which is generally of a hollow metal structure has an upper edge member 21. The upper edge member 21 is cut out to permit installation of an armature assembly generally indicated by the reference numeral 22.

The armature assembly 22 comprises an armature mounting plate or member 23 which is supported from the top edge or rail 21. Affixed to rail 21 at either side of the electromagnic shear lock is a mounting plate 24 which is affixed at either end of the cut-out for the armature assembly by screws or bolts 25. Mounting plates 24 have an extending flange 26 below the top rail 21. Secured to the mounting member 24 as by means of screws or bolts 27 are support and guide members 28 for armature mounting member 23.

Extending downwardly from each of members 28 is a spring loaded vernier bolt 29 having a biasing spring 30 intermediate members 28 and mounting plate 23. The vernier bolts 29 are threadably received in mounting plate 23.

The vernier bolts 29 provide adjustment for the leveling and alignment of armature assembly 22 with respect to the electromagnet 13. Members 28 have spaced-apart depending flanges 31 and 32 which are received within slots 33 and 34 therefor in mounting plate 23.

The armature mounting plate 23 is slidable within the flanges 31 and 32. The flanges 31 and 32 prevent any rocking or rotational movement of mounting plate 23 and provide guides for vertical movement thereof upon installation. The vernier screws or bolts provide the ability to properly level or align mounting plate 23 so as to make the armature parallel to and aligned with the electromagnet. This arrangement permits accurate mounting of the armature assembly using only the vernier bolt or screw 29 at either end of the armature.

The armature 36 comprises an outer generally U-shaped member 37 with another member 38 telescoping slidably therein (FIG. 2). A bolt 39 is threadably received in mounting plate 23 and extends through an aperture 40 in armature member 37 and receives a nut 41 for reasons hereinafter explained. The head 42 of bolt 39 is received in a recess 43 in armature member 38 when the electromagnet is deenergized.

FIG. 2 exemplifies the position of the armature when the electromagnet 13 is energized and FIG. 3 shows the armature when the electromagnet is deenergized. As previously stated, the electromagnet 13 is of generally E-shape in cross-section and has outer legs 45 and 46 and a shorter intermediate leg 47. A coil 48 is positioned about the inner leg and between the outer legs. The inner leg is shorter than the outer legs and helps define a recess 49 in which the armature member 38 fits upon energization of the electromagnet. When this occurs, the legs of armature member 37 engage the outer legs 45 and 46 of electromagnet 13. The armature member 38 is beveled at 50 along one edge thereof for purposes hereinafter described.

The armature members 37 and 38 are movable with respect to mounting plate 23 on guide pins 51 which are secured in armature member 38 and extend into passages in members 37 and 23.

A leaf spring 52 is secured between nut 41 and mounting plate 23. Screws 53 and 54 extend through spring 52, passages 55 in mounting plate 23, and passages in armature member 37, and are threaded into armature member 38.

When the electromagnet 13 is energized and the armature members move to the position shown in FIG. 2, spring 52 will be stressed by heads of the screws 53 and 54 and provide a return force on the armature members when the electromagnet is deenergized. This aids in overcoming any effect of residual magnetism which may be present when the electromagnet is deenergized.

FIG. 5 is a simplified cross section exemplifying an action to pry the armature from an energized electromagnet 13. As shown, the armature member 37 has been pried down. If a tool T such as a large screwdriver is utilized to pry down armature member 37, armature member 38 is still in recess 49, and a magnetic flux path still exists through the electromagnet 13 and armature members 37 and 38 to retain armature member 38 in recess 49 and in a position for mechanical contact with outer legs 45 and 46.

The armature members 37 and 38 are so dimensioned and arranged that armature member 38 will not exit the recess 49 and the outer legs 45 and 46 of electromagnet 13 and the legs of armature member 37 and there will always be a magnetic flux through the armature member 38 and electromagnet 13.

Thus, there will also be a mechanical blockage as between armature member 38, outer legs 45 and 46 of the electromagnet 13 and the legs of armature member 37. Thus, even if armature member 37 is pried down, the mechanical strength of the blockage prevents opening of the door.

Figure 6:
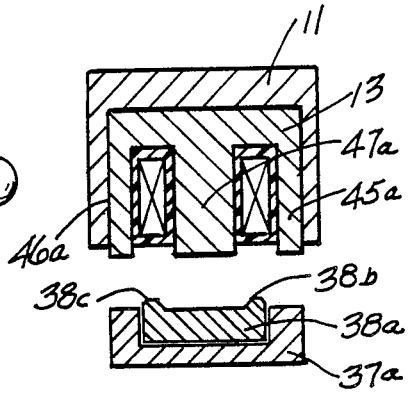
FIG. 6 is a view in half section of an alternate armature assembly to that shown in FIGS. 2 and 3.

FIG. 6 exemplifies an alternate electromagnet and armature construction where the outer legs of the armature 45*a* and 46*a* and the intermediate leg 47*a* are of the same dimension. The armature member 38*a* is formed with small projections 38*b* and 38*c* which will engage the inner surfaces of the outer legs when the electromagnet is energized.

A maximum shear load can be applied if the recess in the electromagnet and the armature member 38 are at ninety degrees to the vertical. However, for emergency doors (fire doors, etc.) it may be desired to provide the bevel 50 on the armature member 38 to facilitate opening of the door in the event the doors are subject to warping and the armature member 38 is jambed in the recess 49. The bevel 50 at an angle of approximately forty-five degrees will permit the opening of the door from the secured side, thus permitting emergency release when the magnet is deenergized.

While the foregoing discussion has been directed to the electromagnet of FIGS. 1–3, the same may be said about the embodiment of FIG. 6 where the ears 38*b* and 38*c* contact the inner surfaces of the legs 45*a* and 46*a*, respectively, of the electromagnet.

The present invention comprises a magnetic shear lock having a very high degree of mechanical strength to prevent unauthorized opening of a door and a new improved and simplified method of mounting an armature system for a magnetic shear lock.

While the invention has been described as soffet and internally door mounted, an electromagnetic shear lock embodying the invention may be surface mounted with the electromagnet mounted to the face of a frame, and the armature assembly mounted to the surface of a door. In such an arrangement, a housing would be provided for the electromagnet to be affixed to the door frame and similarly, a housing would be provided for the armature assembly for mounting to the door.

It may thus be seen that the objects of the invention set forth, as well as those made apparent from the foregoing description, are efficiently attained. While preferred embodiments of the invention have been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A magnetic shear lock of the type comprising one of an electromagnet and an armature for locking a door to a door opening where the door opening is defined by a frame and the door is vertically hinged to said frame for horizontal swinging motion, an electromagnet mounted to the door opening, said electromagnet comprising an E-shaped core having two outer legs and an intermediate leg, all of said legs extending vertically from a common base, an energizing coil wound about said intermediate leg between said outer legs, said outer legs extending beyond said coil and having exposed inside surfaces, an armature member adapted to be mounted to the door for vertical movement and complete magnetic circuits with said legs when said coil is energized, said armature comprising elongated first and second members, said first armature member having a pair of spaced apart legs adapted to engage said outer legs of said electromagnet, said second armature member being slideable within said first armature member and adapted to be received between said exposed surfaces of said outer legs of said electromagnet when said electromagnet is energized.

2. The shear lock of claim 1 where said second armature member has upstanding ears at opposed ends thereof arranged to extend beyond the outer legs of said electromagnet between said exposed surfaces of said outer legs of said electromagnet when said electromagnet is energized.

3. The lock of claim 1 where said intermediate leg of said electromagnet is shorter than said outer legs and a recess is defined between said intermediate leg, said coil and said outer legs, and said second armature member upon energization of said electromagnet is attracted to said electromagnet and resides between said exposed surfaces of said outer legs and within said first armature member.

4. The lock of claim 1 where said first and second armature members are so dimensioned and arranged that if said first armature member is displaced from said electromagnet when said electromagnet is energized, second armature member is magnetically attracted to said electromagnet and contacts exposed side walls of said electromagnet and said first armature member.

5. The lock of claim 1 further including a mounting member for said armature adapted to be supported on a door, a leaf spring secured at a central portion thereof to said mounting member, said spring receiving headed bolts therethrough non-centrally thereof which are secured in said second armature member whereby when said electromagnet is energized and said armature is attracted to said electromagnet said spring is stressed and supplies a return force to said armature when said electromagnet is deenergized.

6. The lock of claim 5 where said second armature member has a recess therein, a headed bolt threaded through said mounting member, said recess receiving the head of said bolt, the bolt extending through said first armature member and determining the extent of movement thereof, and means on said bolt securing the central portion of said spring against said mounting member.

7. A magnetic shear lock of the type comprising one of an electromagnet and an armature for locking a door to a door opening where the door opening is defined by a frame and the door is vertically hinged to said frame for horizontal swinging motion, an electromagnet mounted to the door opening, said electromagnet comprising an E-shaped core having two outer legs and an intermediate leg, all of said legs extending vertically from a common base, an energizing coil wound about said intermediate leg between said outer legs, said outer legs extending beyond said coil and having exposed inside surfaces, an elongated armature member adapted to be mounted to the door for vertical movement and complete magnetic circuits with said legs when said coil is energized, a mounting member for said armature adapted to be supported on the door, a leaf spring secured at a central portion thereof to said mounting member, said spring receiving headed bolts therethrough non-centrally thereof which are secured in said armature member whereby when said electromagnet is energized and said armature is attracted to said electromagnet said spring is stressed and supplies a return force to said armature when said electromagnet is deenergized.

8. A magnetic shear lock of the type comprising one of an electromagnet and an armature for locking a door to a door opening where the door opening is defined by a frame and the door is vertically hinged to said frame for horizontal swinging motion, an electromagnet mounted to the door opening, said electromagnet comprising an E-shaped core having two outer legs and an intermediate leg, all of said legs extending vertically from a common base, an energizing coil wound about said intermediate leg between said outer legs, said outer legs extending beyond said coil and having exposed inside surfaces, an elongated armature member adapted to be mounted to the door for vertical movement and complete magnetic circuits with said legs when said coil is energized, a mounting member for said armature, means connecting said mounting member and said armature to permit movement of said armature with respect to said mounting member, support members for said mounting member affixed to the upper edge of the door at spaced apart positions on either side of said armature, the door being hollow at least at the top thereof, said support members having spaced apart depending flanges receiving said mounting member therebetween adjacent either end of said mounting member, and adjusting means extending from each of said support members into said mounting member to permit height adjustment of each end of said mounting member.

9. The lock of claim 8 where said mounting member has slots defined therein adjacent either end thereof, and said depending flanges are received in said slots.

* * * * *